US006840639B2

(12) United States Patent
Zadro

(10) Patent No.: US 6,840,639 B2
(45) Date of Patent: Jan. 11, 2005

(54) DUAL MAGNIFICATION TABLE TOP/WALL MOUNT MIRROR SYSTEM

(76) Inventor: Zlatko Zadro, 16742 Wanderer La., Huntington Beach, CA (US) 92649

( * ) Notice: Subject to any disclaimer, the term of this patent is extended or adjusted under 35 U.S.C. 154(b) by 206 days.

(21) Appl. No.: 10/237,414

(22) Filed: Sep. 9, 2002

(65) Prior Publication Data

US 2004/0047052 A1 Mar. 11, 2004

(51) Int. Cl.[7] ..... G02B 7/182
(52) U.S. Cl. ..... 359/855
(58) Field of Search ..... 359/855, 850, 359/871, 872; 248/466, 467, 475.1, 476, 477

(56) References Cited

U.S. PATENT DOCUMENTS 3,730,612 A * 5/1973 Arroyo et al. ..... 359/860
4,856,888 A * 8/1989 Wahl ..... 359/881
5,438,457 A * 8/1995 Moore ..... 359/855

* cited by examiner

*Primary Examiner*—Euncha P. Cherry
(74) *Attorney, Agent, or Firm*—William L. Chapin

(57) ABSTRACT

A dual magnification mirror system includes two mirrors having different magnifications, e.g., 5× and 7×, each mounted in a frame fastened to an opposite end of an elongated flexible arm. Each frame is so constructed as to enable it to be interchangeably placeable, mirror face down, on a horizontal supporting surface, such as that of a table or counter top, thus locating the other mirror above the supporting surface, at viewing position which is adjustable by a user by bending the flexible arm. The system also includes a wall mounting bracket fastenable to a vertical wall surface, the mounting bracket having on a front surface thereof a pocket for downwardly insertably receiving and supporting a peripheral flange which protrudes radially outwards from each mirror frame, thus enabling each mirror to be interchangeably inserted into the pocket, and thereby locating the other mirror at a flexibly adjustable viewing position spaced outwardly from the mounting bracket. Preferably, the mounting bracket is provided with rearwardly protruding fasteners, such as suction cups, which are releasably attachable to a vertical surface of an object such as a window, shower door, cabinet or the like.

18 Claims, 4 Drawing Sheets

7X
5X
11
13
14
15
16
17
18
19
20
21
22
23
24
25
26
27
28
29
30
31
32
33
34
35
36
37
38
39
40
41

DUAL MAGNIFICATION TABLE TOP/WALL MOUNT MIRROR SYSTEM

BACKGROUND OF THE INVENTION

A. Field of the Invention

The present invention relates to mirrors of the type used by individuals to facilitate personal care tasks such as combing and brushing one's hair, applying cosmetics, shaving, installing and removing contact lenses, and the like. More particularly, the invention relates to a mirror system which includes a mirror that has two discrete reflecting surfaces of differing magnifications, and a wall mounting bracket fastenable to a wall for releasably holding the mirror in a manner enabling a user to readily and interchangeably position for use a selected one of the two reflecting surfaces, and removing the mirror from the bracket for use as a free-standing mirror supported on a table top or other horizontal surface, with the mirror being readily re-orientable to interchangeably position a selected one of the two magnifying surfaces for use.

B. Description of Background Art

There are a variety of situations in which it would be desirable to have available a mirror with selectable magnifications. For example, a person who is somewhat near-sighted may wish to use a magnifying mirror to install or remove contact lenses, since ordinary flat bathroom mirrors or portable mirrors having a one-to-one, or unity magnification may be inadequate for the task. However, since the field of view of a magnifying mirror is less than that of a unity magnification mirror of the same size, the latter is preferred for certain uses. Thus, a magnifying mirror may be desirable for certain application while at other times a person may wish to have a full face view provided by a mirror having a smaller magnification. Also, a magnifying mirror having different magnifications is useful for people whose vision changes as they age. Applying cosmetics, shaving and performing other such tasks may also be facilitated by the use of a mirror having different, selectable magnifications.

One approach to satisfying the need for a personal hygiene or cosmetic mirror having different magnifications consists of a two-sided mirror, which has on one side thereof a flat mirror plate which has a unity magnification, and on the other side thereof a concave mirror plate having a magnification greater than one, the two mirror plates being arranged in a back-to-back configuration. A variety of such two-sided mirrors exist, which are intended for use while combing one's hair, applying facial makeup, or attending to other tasks related to personal hygiene or appearance. Existing mirrors of the aforementioned type have on one side thereof a flat mirror surface which provides a unity magnification, and on the other side a concave mirror surface having a magnification greater than 1, e.g., 2×,3×,4×, or 5×.

Another type of mirror known to the present inventor which has two discrete magnifications consists of a relatively large oval mirror having a first magnification, unity, for example, and a circular mirror of smaller diameter affixed to or inset into the front surface of the larger oval mirror, the smaller mirror having a concave reflective surface which provides a magnification greater than one.

In U.S. patent application Ser. No. 08/708,290 filed Sep. 7, 1996, now U.S. Pat. No. 5,900,996, issued May 4, 1999, the present inventor disclosed a single-sided mirror having a magnification which may be varied from unity to a substantially larger value, 5×, for example, by axially deforming a flexible mirror plate or diaphragm having a front reflective mirror surface, the deformation decreasing the focal length of the mirror. Also, the present inventor disclosed in U.S. Pat. No. 6,305,809, issued Oct. 23, 2001, a variety of novel mirrors with multiple selectable magnifications, which include bases for supporting the mirrors in free-standing positions on a level surface such as that of a desk or table top. However, the present inventor is unaware of any existing mirror designs which have the desirable feature of being readily interchangeably useable as a free-standing mirror or as a wall mount mirror mountable to a vertical surface such as that of a shower wall, medicine cabinet mirror, window or the like. Accordingly, the present invention was conceived of to provide a dual magnification mirror which may be placed in an upstanding position for use on any convenient horizontal supporting surface of an object such as a table and which may be readily relocated from a self-standing location on such surface and releasably attached to a wall mount bracket which is in turn releasably fastenable to a vertical surface such as a window, shower door or the like.

OBJECTS OF THE INVENTION

An object of the present invention is to provide a dual magnification mirror that has two reflecting surfaces which are interchangeably orientable to an adjustable viewing position above a horizontal supporting surface.

Another object of the invention is to provide a dual magnification mirror system that has two different reflecting surfaces which are interchangeably orientable to an adjustable viewing position above a horizontal supporting surface, the system including means for interchangeably fastening the mirror to a vertically disposed wall surface with a selected one of the reflecting surfaces in a viewing position away from the wall.

Another object of the invention is to provide a dual magnification mirror that includes a first mirror support frame which holds a first mirror that has a first magnification, a flexible support arm having a first end which protrudes from a rear surface of the first mirror support frame, and a second mirror support frame which holds a second mirror that has a second magnification different from the magnification of the first mirror, the second mirror frame being supported by a second end of the arm which protrudes from the rear surface of the second frame, thus enabling the first and second frames to be used as support bases interchangeably placeable face downwards onto a supporting surface such as a table top, with the second and first mirrors interchangeably locateable at the upper end of the flexible support arm to an adjustable viewing position above the supporting surface.

Another object of the invention is to provide a dual magnification, free-standing table top mirror, which is interchangeably mountable to a vertical surface.

Another object of the invention is to provide a dual magnification mirror system having a first mirror support frame holding a first mirror having a first magnification, a second mirror support frame holding a second mirror having a second magnification, an adjustable arm supporting at opposite ends thereof rear surfaces of the first and second mirror support frames at an adjustable angle relative to one another, and a wall mounting bracket which is attachable to a wall surface and which has protruding from an outer surface thereof a pocket for vertically downwardly receiving and releasably supporting interchangeably the first and second mirror support frames, to thereby interchangeably position a selected one of the second and first mirrors at an adjustable viewing position located outwards from the vertical wall surface.

Another object of the invention is to provide a mirror system which has two mirror support frames attached to opposite ends of an elongated flexible support arm, each frame holding a mirror having a magnification different from the mirror held by the other frame and being placeable face down on a horizontal supporting surface to serve as a stand base, the arm being adjustable to adjustably position the other mirror at a suitable viewing position above the horizontal supporting surface, and a wall mounting bracket releasably attachable to a vertical wall surface such as that of a window, larger flat mirror, shower door or the like, by releasable means such as suction cups or magnets, the wall mounting bracket having protruding from an outer, front vertical surface thereof a plurality of channel members which form a pocket adapted to vertically downwardly and slidably receive and hold a selected one of the mirror support frames to thereby releasably and interchangeably position a mirror of a selected magnification at an adjustable position spaced outwards from the vertical wall surface.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a mirror system which includes a dual magnification mirror that is useable both in a free-standing position on a table top or other horizontal surface, and interchangeably mountable to a vertical wall surface such as a shower door, large flat mirror, window or the like. A preferred embodiment of a dual magnification mirror system according to the present invention includes a pair of circular dish-shaped mirror support frames each holding. within a circular bezel set in a concave front portion of the frame a circular mirror, the two mirrors having different magnifications. Preferably, the two mirrors have concave reflecting surfaces which have different curvatures that provide different magnifications, e.g., 5× and 7×. Optionally, one of the two mirrors may have a flat reflecting surface which provides 1×, or unity magnification.

The two circular mirror support frames are joined by an elongated, flexible, "gooseneck" arm, opposite ends of which protrude perpendicularly rearward from rear surfaces of the mirror frames, coaxially with the bezel. When the front bezel surface of mirror support frame is placed in flat parallel contact with a horizontal support surface such as that of a table top, counter top or the like, that mirror support frame serves as a stand base, and the flexible gooseneck arm protruding upwards from the mirror support frame serves as an adjustable stanchion for supporting the other mirror support frame at a position above the support surface which is readily adjustable by an individual to suit his or her viewing needs. When a different magnification is desired by the user, the arm is grasped, rotated 180 degrees in a vertical plane, and the other mirror support frame placed on a support surface to thus position the opposite mirror with a desired magnification in a desired orientation for use by an individual.

A dual magnification mirror system according to the present invention includes a mirror support structure comprising a wall mounting bracket which is attachable to a generally vertical surface, such as that of a structure wall, shower door, medicine cabinet mirror, window or the like. A wall mounting bracket for a dual magnification mirror system according to the present invention includes a generally flat, rear backing plate which is attachable to a vertical wall surface, and a mirror support structure which protrudes forward from the backing plate. According to the invention, the mirror support structure of the wall mounting bracket is so constructed as to releasably and interchangeably support either circular mirror support frame, thus positioning the opposite mirror at the opposite end of the flexible support arm at an adjustable orientation outwards from the vertical wall surface.

In a preferred embodiment, the mirror wall mounting bracket has a plurality of circumferentially spaced apart channel members which protrude forward from the rear backing plate, the channel members having formed between rear and front parallel walls thereof generally vertically disposed channels which define a pocket for downwardly insertably receiving and holding therewithin an annular ring-shaped flange which protrudes radially outwards from the bezel ring of each circular mirror frame. Preferably, the wall mounting bracket has three circumferentially spaced apart channel members; one located at the bottom and two at opposite sides of a semicircular lower half of the mounting bracket backing plate. In a most preferred embodiment, a lower semi-circularly-shaped portion of the wall mount bracket backing plate has a thin, semi-circular hoop-shaped flange which protrudes perpendicularly forwards from the backing plate, the flange having three integrally formed ear portions which are bent inwardly and parallel to the rear backing plate to form two discrete channel members at opposite lateral ends, and one channel member at the bottom, respectively, of the semi-circularly-shaped rear backing plate.

A preferred embodiment of a dual magnification mirror system according to the present invention includes fastener means for releasably fastening the backing plate of the wall mounting bracket to a vertical surface, such as that of a shower door, window, or large flat mirror of the type found in most bathrooms. A preferred releasable backing plate fastener means according to the present invention includes a plurality, preferably three, of suction cups which protrude rearwards from the rear backing plate. To facilitate removal of the wall mounting bracket from a vertical wall surface, the suction cups are preferably removably attachable to the backing plate. This construction enables the backing plate to be detached from the suction cups, which are then more readily released individually from sealing engagement with a wall surface by peeling an edge of each suction cup away from the wall surface.

In a preferred embodiment, each suction cup has protruding upwards from the inverted cup-shaped base thereof, a neck or stem terminated at an upper, outer end thereof by a disk-shaped head of larger diameter than the stem but smaller diameter than the base. In this embodiment, the wall mounting bracket backing plate has through its thickness dimension three keyholes spaced circumferentially apart at 120 degree intervals. Each keyhole has a generally circularly-shaped lower portion of a diameter sufficiently large to insertably receive the head of a suction cup, and a vertically upwardly protruding oval-shaped slot of smaller width than the suction cup head, but of sufficient width to enable the neck of the suction cup to slide upwardly in the slot, thus securing the larger diameter head behind the upper end of the slot. This construction enables the suction cups to be attached to the wall mounting bracket backing plate, whereupon the rear surfaces of the suction cups are placed against a flat vertical wall surface, and the backing plate pressed down towards the support surface to hermetically adhere the suction cups to the surface. A selected one of the mirror support frames is then inserted downwards into the pocket located on the front surface of the mounting bracket.

To remove the wall mounting bracket, the mirror is slid upwardly out from the pocket, the backing plate is slid upwardly to thereby position the suction cup heads beneath the larger diameter, lower portions of the keyholes, and the backing plate pulled forwards away from the mounting surface, the larger diameter lower portions of the keyholes enabling the suction cup heads to be pulled through the keyholes. The suction cups are then individually removed from hermetic contact with the supporting surface. In a preferred embodiment, each suction cup is provided with a small lifting tab which protrudes radially outwards from a lower peripheral edge of the surface-contacting edge wall of the suction cup. Grasping this tab and pulling it away from a surface to which the suction cup is hermetically adhered breaks the hermetic seal between the surface and the suction cup, enabling the suction cup to be easily detached from the surface.

DESCRIPTION OF THE PREFERRED EMBODIMENTS

Figures 1, 2:
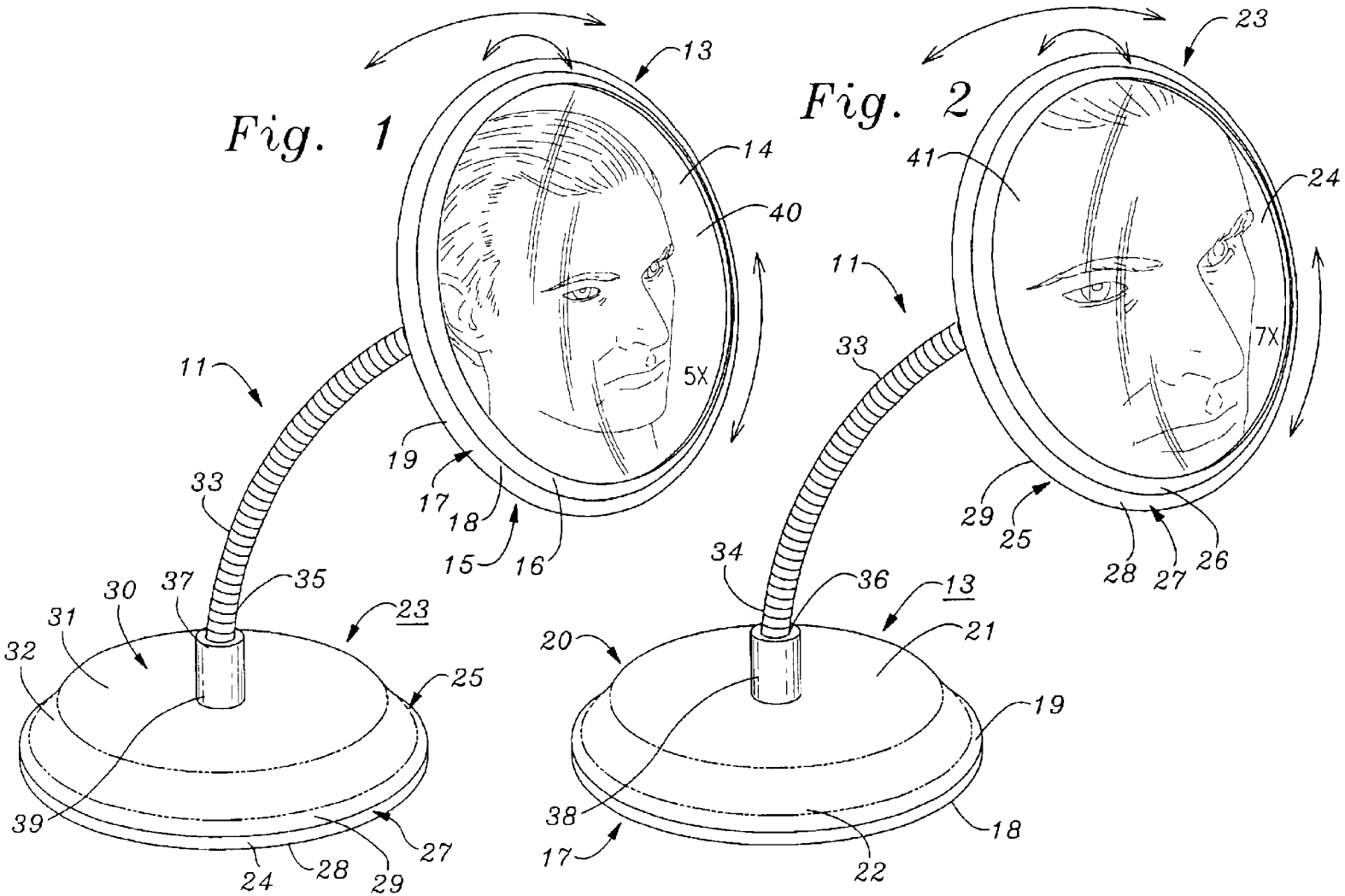
FIG. 1 is a perspective view of a dual magnification table top-mount mirror comprising a component of a dual magnification table top/wall mount mirror system according to the present invention, showing the mirror supported on a table top with a first mirror thereof orientated for use.
FIG. 2 is a view similar to that of FIG. 1, but showing a second mirror thereof oriented for use.

FIGS. 1–6 illustrate a dual magnification table top/wall mount mirror system 10 according to the present invention in which FIGS. 1–2 illustrate a dual magnification mirror 11 of the system in use as a table top mirror, and FIGS. 3–6 illustrate the use of the mirror with a wall mounting bracket 12 comprising another component of the system.

Referring now to FIGS. 1 and 2, a dual magnification mirror 11 according to the present invention may be seen to include a pair of mirror assemblies 13 and 23 which are substantially identical in structure and function, but which have reflective mirror plates 14 and 24, respectively, of different desired magnifications. Thus, for example, reflective mirror plate 14 of mirror assembly 13 has a concave outer surface which produces a reflected image having a first magnification, e.g., 5×. Mirror plate 24 of mirror assembly 23 has a different curvature than that of mirror plate 14. For example, mirror plate 24 may have a greater curvature than mirror plate 14, thus causing mirror plate 24 to have a higher magnification, e.g. 7×. Optionally, mirror plate 24 may have less curvature than mirror plate 14, producing less magnification, or may be flat, producing 1× magnification.

Referring still to FIGS. 1 and 2, it may be seen that mirror assemblies 13 and 23 each include a circular plan-view rear support housing 15, 25, respectively. Each support housing 15, 25 has a concave front surface (not shown) which receives mirror plates 14, 24, respectively. Mirror plates 14, 24 are held within housings 15, 25, respectively, by flat annular ring-shaped bezel rings 16, 26, respectively, which have an inner diameter slightly greater than the, outer diameters of the mirror plates. Bezel rings 16, 26 have flat annular ring-shaped flange portions 17, 27 of generally uniform thickness, which protrude radially outwards from housings 15, 25. Flanges 17, 27 have generally parallel front and rear surface pairs 18, 19, and 28, 29, respectively. Although the shape of rear surfaces 20, 30 of housings 15, 25 is not critical, a suitable shaped rear surface includes a central arcuately curved convex portion 21, 31, which is joined to flange 17, 27 by a beveled annular ring-shaped section 22, 32.

Referring still to FIGS. 1 and 2, it may be seen that mirror assemblies 13 and 23 are joined together by a flexible arm 33. Preferably, flexible arm 33 is a spirally formed steel tube in which adjacent spiral convolutions are flexibly joined, but frictionally engaged with one another to maintain an adjusted flexure of the arm. Opposite ends 34, 35 of flexible arm 33 are secured within the bores 36, 37 of cylindrically-shaped bosses 38, 39 which protrude perpendicularly rearwards from the center of convex rear surfaces 21, 31 of mirror assemblies 13, 23.

As shown in FIGS. 1 and 2, the front surfaces 40, 41 of mirror plates 14, 24 are recessed inwardly of front surfaces 18, 28 of bezel ring flanges 17, 27, respectively, thus when support housing 15 or 25 of a mirror assembly 13 or 23 is placed face down on a horizontal support surface such as that afforded by a table top, counter top or the like, front bezel ring flange surface 18 or 28 rests flush on the supporting surface. With this arrangement, mirror housing 15 or 25 serves as a stand base, and flexible arm 33 serves as an adjustable stanchion for supporting an opposite mirror assembly 23 or 13, respectively. As indicated by the double ended arrows in FIGS. 1 and 2, the flexibility of arm 33 enables mirror assembly 13 or 23 to be adjusted over a wide range of spatial positions and angular orientations relative to an opposite mirror assembly 23 or 13 which is serving as a support base.

Figure 3:
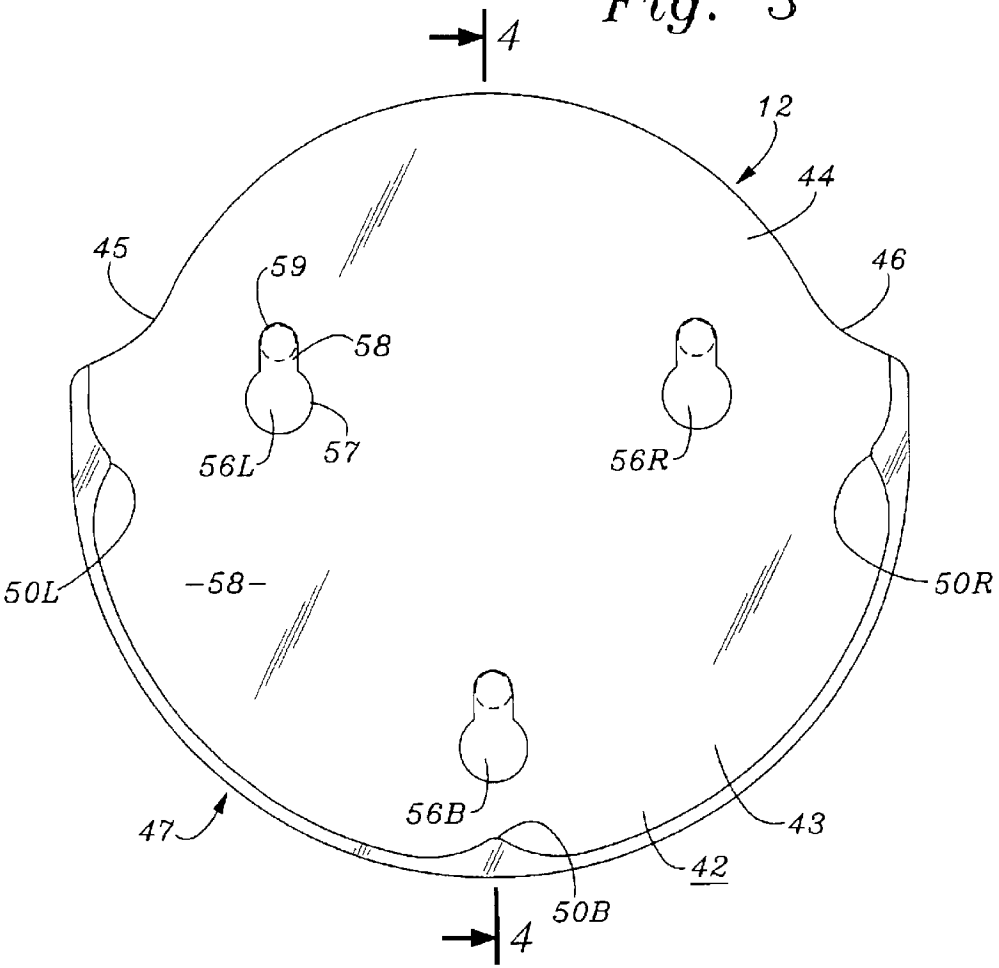
FIG. 3 is a front elevation of a wall mounting bracket for the mirror of FIG. 1.
Figure 4:
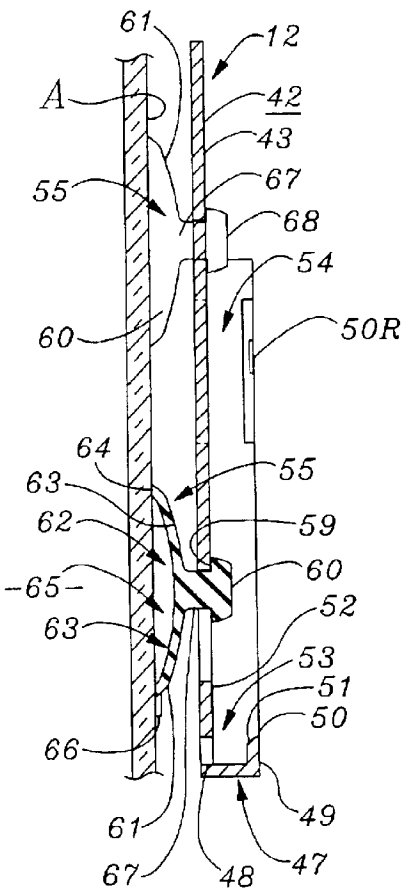
FIG. 4 is a sectional view of the wall mounting bracket of FIG. 3, taken in the direction of line 4—4.

Referring now to FIGS. 3 and 4, wall mounting bracket 12 of mirror system 10 may be seen to include a flat backing plate 42. As shown in FIG. 3, backing plate 42 has a generally semicircularly-shaped lower portion 43 which is joined at an upper horizontal diameter thereof to a semicircularly sector-shaped upper portion 44 of smaller diameter than lower portion 43, by concave arcuately curved left and right transition sections 45,46.

Figure 6:
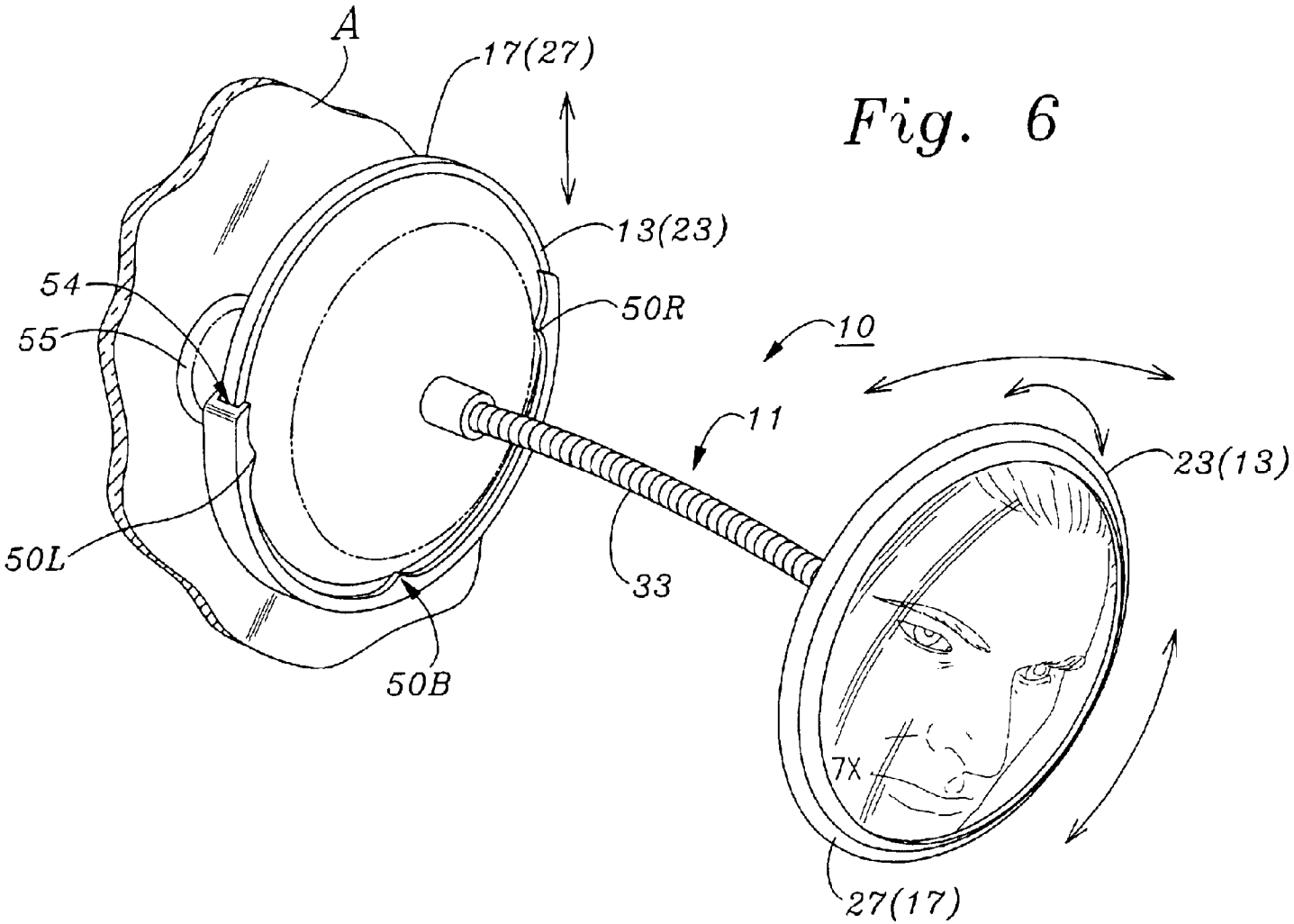
FIG. 6 is a perspective view showing the mirror of FIGS. 1 and 2 releasably held in the wall mounting bracket of FIG. 5.

As shown in FIGS. 3 and 4, backing plate 42 of wall mounting bracket 12 has a generally semi-circularly hoop-shaped flange 47 which protrudes perpendicularly outwardly or forwards from lower semicircular edge wall 48 of the backing plate. Flange 47 has protruding radially inwardly from front, outer edge wall 49 thereof a plurality of tabs 50 or ears which have in plan view a convex arcuately curved shape. Tabs 50 each have a flat inner surface 51 parallel to outer, front surface 52 of lower portion 43 of backing plate 42. Preferably, bracket 12 has three retainer flanges or ears 50, comprising a pair of left and right ears 50L, 50R located at opposite ends of a chord situated just below an upper horizontal diameter of lower portion 43 of backing plate 42, and a third ear 50B located at the bottom of lower portion 43 of a chord just below the backing plate, i.e., located ninety degrees circumferentially apart from the left and right ears. As may be seen best by referring to FIG. 4, a rectangularly-shaped channel 53 is formed between the inner circumferential wall surface 47A of hoop-shaped flange 47, rear surface 51 of each ear 50, and front surface 52 of backing plate 42. Moreover, the front and rear wall surfaces 51 and 52 of each channel 53L, 53R, 53B are coplanar with one another, thus forming a generally semi-circularly-shaped, three-segment pocket 54 adapted to receive insertably downwards and support therein a lower semi-circular half portion of a circular bezel flange 17 or 27 of a mirror frame housing 15 or 25, as shown in FIG. 6.

Wall mounting bracket 12 of mirror system 11 includes fastener means for attaching backing plate 42 of wall mounting bracket 12 to a vertical wall surface of a structure such as a bathroom shower door or mirror, window or room wall, or the like. In a preferred embodiment of mirror system 11, the wall mounting bracket fastener means are so constructed as to enable backing plate 42 of wall mounting bracket 12 to be easily fastened to and removed from a vertical wall surface, thus enabling the wall mounting bracket to be readily transported between different locations, and without leaving any marks on the wall mounting surface.

Referring again to FIGS. 3 and 4, it may be seen that a preferred fastener means for removably attaching backing plate 42 of wall mounting bracket 12 to a wall surface includes a plurality, preferably three, of suction cups 55. Thus, as shown in FIG. 3, backing plate 42 of wall mounting bracket 12 has formed through its thickness dimension three perforations 56L, 56R, and 56B for holding three suction cups 55. Although the exact location of perforations 56 is a matter of ordinary design choice, the perforations are preferably spaced circumferentially apart at 120-degree intervals, one each of the perforations being proximate ears 50L, 50R, and 50B, as shown in FIG. 3.

Referring still to FIG. 3, it may be seen that each perforation 56 has the shape of a keyhole, including a lower portion 57 which has the approximate shape of a 270-degree sector of a circle, and an upper vertically elongated slotted portion 58 which extends vertically upwards from the lower three-quarter circular portion, laterally centered between the sides thereof. Preferably, the upper end of slotted portion 58 of keyhole has an upwardly convex, semi-circular shape, defined by an adjacent upwardly concave peripheral edge wall 59 of the slot.

Referring now to FIG. 4 in addition to FIG. 3, it may be seen that each suction cup 55 has a lower circular cup-shaped portion 60 which includes a convex, arcuately curved, generally spheroidal section-shaped upper wall surface 61, a lower concave opening 62, and a circularly symmetric, arcuately curved flange 63 formed between the upper and lower surfaces. Flange 63 has a lower circular ring-shaped, transversely disposed edge wall 64.

Suction cup 55 is preferably made of a relatively soft, flexible, tacky elastomeric material such as natural rubber, silicone rubber, or vinyl. Thus, when lower annular edge wall 64 of suction cup 55 is pressed downwards against a smooth, flat surface A such as that of a shower door, with sufficient force, air within interior space 65 of concave inner portion 62 of the suction cup is forced out through the junction between the annular edge wall 64 and surface A. Therefore, when downward pressure on suction cup 55 is released, cup-shaped portion 60 resiliently returns to its undeformed shape, causing a partial vacuum to be produced within interior space 65 of the suction cup. This results in atmospheric pressure exterior to outer surface of suction cup body 60 pressing annular edge wall 64 into sealing contact with surface A, thereby hermetically adhering the suction cup body to surface A. Since this adhering force can be quite large, suction cup 55 is preferably provided with a tab 66 which protrudes radially outwards and upwards from a peripheral edge of lower annular edge wall 64. Grasping tab 66 and pulling it away from surface A distorts lower edge wall 64 from its flat ring-shape, thus allowing air to enter interior space 65 of the suction cup and enabling the suction cup to be readily removed from attachment to surface A.

Figure 5:
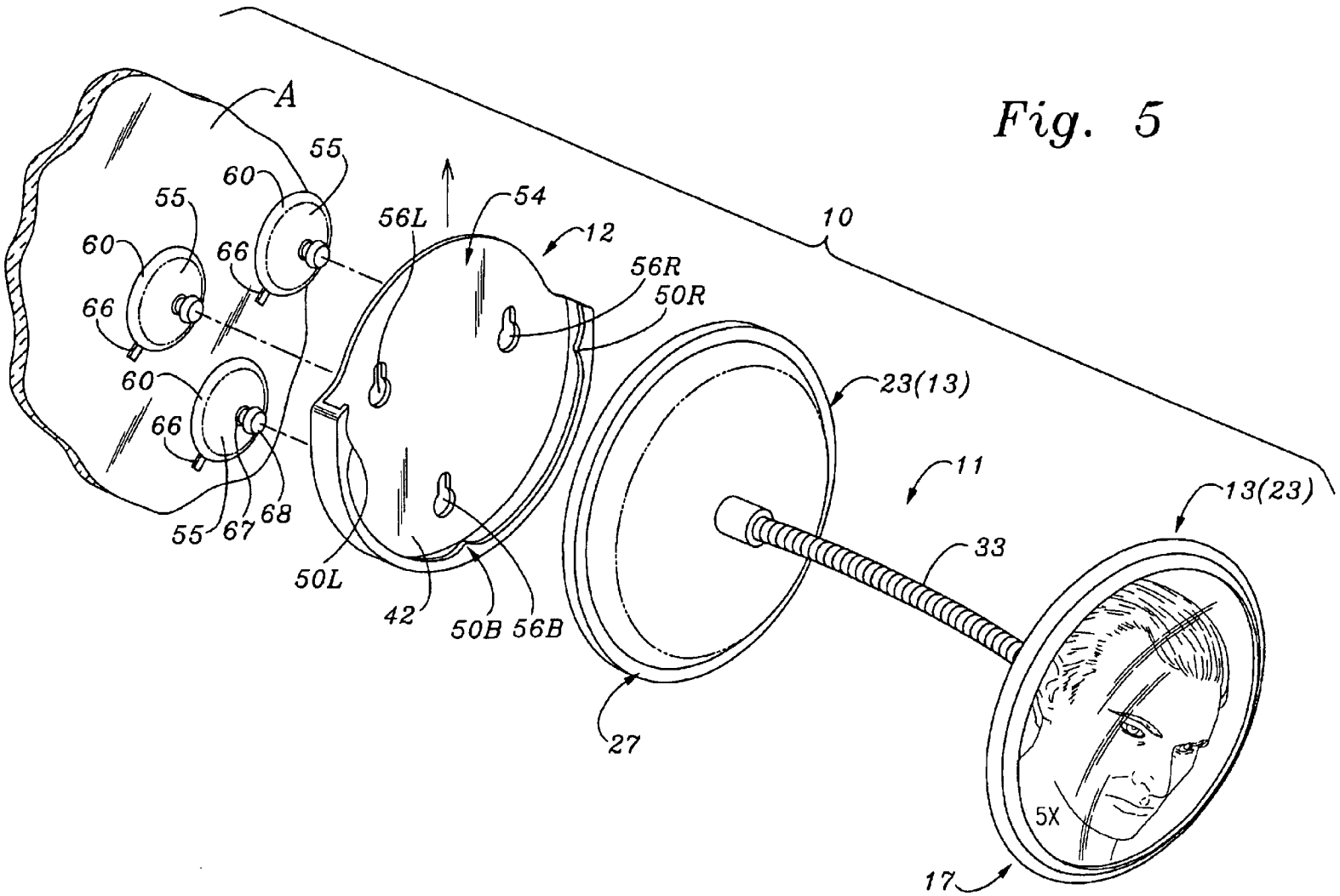
FIG. 5 is an exploded perspective view of the mirror system according to the present invention including the mirror of FIG. 1 and wail mounting bracket of FIGS. 3 and 4, and showing a method of releasably attaching the wall mounting bracket to a vertical wall surface.

As shown in FIGS. 4 and 5, each suction cup 55 has a small diameter neck or stem 67 which protrudes perpendicularly upwards from the center of upper surface 61 of lower cup-shaped body 60 of the suction cup. Neck 67 is terminated at the upper end thereof by a circular button-shaped head 68.

As may be best understood by referring to FIGS. 3, 4, and 5, each suction cup 55 is individually and releasably attached to backing plate 42 of wall mounting bracket 12 by inserting head 68 forward through lower larger diameter portion 57 of a keyhole aperture 56, whereupon neck 67 of the suction cup is slid upwardly into slotted portion 58 of the keyhole aperture sufficiently far for neck 67 to abut upper edge wall 59 of the slot. As stated above, suction cup 55 is made of a resiliently deformable elastomeric material. Also, neck 67 is of slightly greater diameter than the width of slot 58, and the clearance between upper surface 68 of body 60 and lower surface 69 of head 68 may be slightly less than the thickness of backing plate 42. Therefore, when neck 67 of a suction cup 55 is slid upwardly into keyhole aperture 56, the suction cup remains attached to backing plate 42 by an interference fit.

FIGS. 4–6 illustrate how mirror 11 of mirror system 10 is interchangeably mounted within wall mounting bracket 12 to interchangeably position mirror assemblies 13 and 23 outwardly from a wall mounting surface A. As shown in FIG. 4, suction cups 55 are attached to wall mounting bracket 12 in the manner described above. Next, as shown in FIGS. 4 and 6, edge walls 64 of suction cups 55 are placed in contact with wall mounting surface A, and a downward force exerted on backing plate 42, causing the suction cups to adhere to the wall mounting surface. Then, as shown in FIG. 6, bezel flange 17 or 27 of frame 13 or 23 is slid downwardly into pocket 54 of wall mounting bracket 12, thus securing frame 13 or 23 within the mounting bracket, and positioning the opposite frame 23 or 13 in an adjustable viewing position outwards from wall surface A. When it is desired to position the opposite mirror for use outwardly from the wall surface A, the frame held within pocket 54 of wall mounting bracket 12 is slid upwards out of the pocket to release it from engagement with the wall mounting bracket, and mirror 11 is rotated 180 degrees to position the opposite frame adjacent pocket 54, and that frame is then inserted into the pocket. As indicated by the double ended arrows in FIG. 16, flexible arm 33 enables mirror assembly 23 or 13 to be adjusted to a wide range of positions and orientations relative to wall mounting bracket 12.

To unfasten wall mounting bracket 12 from wall surface A, the mounting bracket is lifted upwards to disengage keyholes 56 from suction cups 55, and pulled away from wall mounting surface A. Then, as shown in FIG. 5, each suction cup may be individually removed from wall mounting surface A by pulling upwardly on tabs 66 of individual suction cups 55, in a manner described above.

Certain modifications of the preferred embodiment of the invention described above may optionally be made while still retaining novel and advantageous features of the invention. For example, the semi-circular lower portion of the wall mounting bracket backing plate may utilize separate channel members attached to the backing plate, rather than employing channel members integrally formed with the backing plate. The mirror frames and backing plate may also have different plan view shapes, e.g., oval, rectangular or square. If desired, the wall mounting bracket may be semi-permanently fastened to a wall by removing the suction cups from the backing plate and attaching the backing plate to a wall by screws inserted through the keyholes and screwed into the wall. And, for those applications in which a ferromagnetic vertical wall mounting surface is available, such as a panel of a steel locker, cabinet or the like, the backing plate suction cups may be replaced by flat permanent magnets.

What is claimed is:

1. A mirror system having two mirrors of different properties which are interchangeably supportable on a horizontal object surface and mountable on a vertical wall surface with an interchangeably selected one of said mirrors positioned for viewing, said mirror system comprising;

a. a first mirror frame holding therein a first mirror having a first type mirror surface, b. a second mirror frame holding therein a second mirror having a second type mirror surface, c. an arm which joins said first and second frames, said first and second frames being interchangeably placeable with said mirror surface facing down on a horizontal support surface to thereby interchangeably position said second and first mirrors, respectively, above said horizontal support surface, and d. wall mounting bracket means including (i) fastener means for attaching said wall mounting bracket to a generally vertically oriented wall surface, and (ii) releasable retainer means for selectably and interchangeably holding said first and second mirror frames with said second and first type mirror surfaces, respectively, spaced away from said wall surface.

2. The mirror system of claim 1 wherein at least one of first and second mirror frames is adjustable in position relative to said arm.

3. The mirror system of claim 1 wherein said arm is of a flexible construction enabling adjustment of the relative position of both said first and second mirror frames relative to said arm.

4. The mirror system of claim 1 wherein said releasable retainer means for interchangeably holding said first and second mirror frames is further described as comprising in combination a downwardly opening pocket in a front portion of a backing plate of said wall mounting bracket, and a separate mounting flange protruding radially outwardly from each of said first and second frames, respectively, said mounting flange being vertically insertably receivable in said pocket and supported therein.

5. The mirror system of claim 4 wherein each said mounting flange of said first and second mirrors is further defined as having an annular ring shape.

6. The mirror system of claim 5 wherein each of said mounting flanges is further defined as having generally parallel front and rear surfaces.

7. The mirror system of claim 4 wherein said pocket is further defined as comprising in combination a plurality of circumferentially spaced apart channel members which protrude forward from said backing plate of said wall mounting bracket, said channel members having front and rear opposed wall surfaces which define front and rear surfaces, respectively, of said pocket.

8. The mirror system of claim 7 wherein said plurality of channel members is further defined as including a pair of horizontally opposed side channel members and a bottom channel member spaced equidistant from said side channel members.

9. The mirror system of claim 7 wherein each of said channel members is further defined as comprising a tab angled radially inwardly and downwardly from a peripheral flange which protrudes forwards from a lower portion of said backing plate, to thereby overlie said backing plate.

10. The mirror system of claim 9 wherein said plurality of channel members is further defined as including a pair of horizontally opposed side channel members and a bottom channel member spaced equidistant from said side channel members.

11. The mirror system of claim 9 wherein said tabs are further defined as being integrally formed with said peripheral flange.

12. The mirror system of claim 1 wherein said releasable fastening means for fastening said backing plate of said wall mounting bracket to said vertical wail surface is further defined as comprising at least a first suction cup having a concave lower ring-shaped portion which is resiliently deformable.

13. The mirror system of claim 12 further including means for releasably attaching said suction cup to said backing plate.

14. The mirror system of claim 13 wherein means for releasably attaching said suction cup to said backing plate is further defined as comprising in combination a stem protruding upwards from said resilient lower cup-shaped portion of said suction cup, a button-shaped head of larger diameter than said stem located at the upper end thereof, and a keyhole-shaped aperture through said backing plate, said keyhole-shaped aperture having a lower generally circularly-shaped portion of sufficient diameter to insertably receive said head of said suction cup, and slotted portion which protrudes radially from said lower portion, said slotted portion being of a width sufficient to slidably receive said stem of said suction cup, but smaller than the diameter of said head.

15. The mirror system of claim 14 further including a second aperture and a second suction cup releasably receivable therein.

16. The mirror system of claim 15 further including a third aperture and a third suction cup releasably receivable therein.

17. The mirror system of claim 16 wherein said first, second and third apertures are circumferentially spaced apart from one another.

18. The mirror system of claim 16 wherein said first, second and third apertures are circumferentially spaced apart from one another at 120 degree intervals.

* * * * *